US007240863B2

(12) United States Patent
Ettaleb et al.

(10) Patent No.: US 7,240,863 B2
(45) Date of Patent: Jul. 10, 2007

(54) METHOD OF REFINING WOOD CHIPS OR PULP IN A HIGH CONSISTENCY CONICAL DISC REFINER

(75) Inventors: Lahoucine Ettaleb, Pointe-Claire (CA); Alain André Roche, Montreal (CA); Keith Miles, Montreal (CA)

(73) Assignee: FPInnovations, Pointe Claire, Quebec (CA)

( * ) Notice: Subject to any disclaimer, the term of this patent is extended or adjusted under 35 U.S.C. 154(b) by 85 days.

(21) Appl. No.: 11/133,306

(22) Filed: May 20, 2005

(65) Prior Publication Data

US 2006/0180684 A1 Aug. 17, 2006

Related U.S. Application Data

(60) Provisional application No. 60/651,653, filed on Feb. 11, 2005.

(51) Int. Cl.
*B02C 1/00* (2006.01)
*B02C 11/08* (2006.01)
*B02C 4/32* (2006.01)

(52) U.S. Cl. ..... 241/21; 241/28; 241/34

(58) Field of Classification Search ..... 241/33, 241/261.1, 261.2, 261.3, 21, 28, 34
See application file for complete search history.

(56) References Cited

U.S. PATENT DOCUMENTS 3,802,964 A 4/1974 Forgacs et al.
4,148,439 A * 4/1979 Floden ..... 241/28
4,342,618 A 8/1982 Karnis et al.
4,963,229 A 10/1990 Lisnyansky et al.
6,024,308 A 2/2000 Bartels et al.
6,336,602 B1 1/2002 Miles
6,567,766 B2 5/2003 Johansson et al.
6,587,803 B2 7/2003 Johansson
6,752,165 B2 6/2004 Johansson (Continued)

FOREIGN PATENT DOCUMENTS

CA 1267016 3/1990

OTHER PUBLICATIONS

James Owen et al, "A Practical Approach to Operator Acceptance of Advanced Control With Dual Functionality", Control Systems '98, Sep. 1-3, 1998, Porvoo, Finland, pp. 184 to 194.

(Continued)

*Primary Examiner*—Faye Francis
(74) *Attorney, Agent, or Firm*—Ogilvy Renault LLP

(57) ABSTRACT

A method is proposed for improving pulp quality at high production rates on conical disc refiners. It permits a reduction in refining intensity by enabling fibre residence time to increase by increasing consistency, while avoiding the problem of plate plugging normally associated with high discharge consistency. In practice, inlet consistency is increased by the in-feed dilution, flat zone dilution or both, but without allowing the discharge consistency to rise. Instead, the discharge consistency is controlled at a fixed optimum value by the addition of dilution water within the conical zone. The result is that residence time is increased, and refining intensity decreased, by raising the consistency in the inner region of the refining zone, while avoiding the plate plugging caused by excessive consistency in the outer region of the refining zone.

18 Claims, 3 Drawing Sheets

U.S. PATENT DOCUMENTS

| | | | | |
|---|---|---|---|---|
| 6,778,936 | B2 | 8/2004 | Johansson | |
| 6,938,843 | B2 * | 9/2005 | Johansson | 241/21 |

OTHER PUBLICATIONS

K.D. Murton et al, "Production Rate Effect on TMP Pulp Quality and Energy Consumption", Journal of Pulp and Paper Science: vol. 23, No. 8, Aug. 1997, pp. J411 to J416.

B.C. Strand et al, "The Effect of Production Rate on Specific Energy Consumption in High Consistency Chip Refining".

K.B. Miles et al, "The Flow of Pulp in Chip Refiners", Journal of Pulp and Paper Science: vol. 16, No. 2, Mar. 1990, pp. J63 to J72.

K.B. Miles, "A Simplified Method for Calculating the Residence Time and Refining Intensity in a Chip Refiner", Paper and Timber 73 (1991):9, pp. 852 to 857.

K. Miles, "Refining Intensity and Pulp Quality in High-Consistency Refining", Paper and Timber 72 (1990):5, pp. 508 to 514.

K.B Miles et al, "Predicting the Performance of a Chip Refiner; a Constitutive Approach", Journal of Pulp and Paper Science: vol. 19, No. 6, Nov. 1993, pp. J268 to J274.

K.B. Miles et al, "Wood Characteristics and Energy Consumption in Refiner Pulps", Journal of Pulp and Paper Science: vol. 21, No. 11, Nov. 1995, pp. J383 to J389.

* cited by examiner

METHOD OF REFINING WOOD CHIPS OR PULP IN A HIGH CONSISTENCY CONICAL DISC REFINER

CROSS-REFERENCE TO RELATED APPLICATIONS

This application is related to U.S. Provisional Application Ser. No. 60/651,653 filed Feb. 11, 2005 and the benefit under 35 USC119(e) of such U.S. Provisional Application is claimed.

BACKGROUND OF THE INVENTION

1. Field of the Invention

This invention relates to a method of refining wood pulp; more especially the invention relates to such a method in which pulp consistency in the refiner is adjusted by controlled addition of dilution water to the refiner.

In a preferred embodiment, the present invention relates to a method for controlling TMP (thermomechanical pulp) refiners by adjustment of the refining intensity. Pulp consistencies in the refiner are controlled and adjusted to achieve stable refining intensity and to compensate for disturbances such as the ones associated with changes in production rate.

2. Description of the Prior Art

The quality of the pulp in thermomechanical pulp (TMP) refining is very much a function of the applied specific energy defined as the energy per tonne of production. The conventional approach to control pulp quality is therefore to adjust the specific energy either through changes in refiner motor load or through changes in refiner throughput, Owen J. et al "A practical approach to operator acceptance of advanced control with dual functionality. Proceedings Control Systems 98, Porvoo, Finland".

Pulp quality also depends on the rate at which this energy is applied as expressed by the refining intensity or the specific energy per bar impact, Miles K. "A Simplified Method for calculating the residence time and refining Intensity in a chip refiner" Paperi ja Puu, 73(9):852–857 (1991)". In practice, at a given specific energy, this refining intensity varies with pulp consistency. Pulp consistency affects the pulp residence time which itself is inversely proportional to the refining intensity. In an increasing number of installations the consistency of the pulp, as measured or estimated in the blow line, is controlled by adjusting the flow rate of dilution water into the refiner. Such consistency control helps to maintain discharge consistency in the appropriate range for the good operation of the refiner.

In large modern TMP refiners such as the Sunds CD 82 or some of the CD 76 refiners operating at very high refining consistency, there are up to three possible dilution flows that can be adjusted to change pulp consistency (as shown in FIG. 1): the infeed dilution or water added to the pulp or the chips before the refining zones, dilution water added to the flat zone of the refiner, and in some modern installations, the dilution water added to the conical zone. The purpose of adding dilution water in the conical zone is to reduce the occurrence of very high consistencies at the periphery of the plates and the associated plugging of the plates.

Although pulp consistency varies and normally increases from the refiner inlet to the refiner discharge or blow line, the term refiner pulp consistency conventionally denotes the consistency of the pulp at the refiner discharge. This pulp consistency is either measured on manual samples, estimated using predictive models, or measured on-line using commercially available sensors. In an increasing number of installations the consistency of the pulp is controlled through a single control loop where the three mentioned flow dilutions (in-feed, flat zone and conical zone dilution) are manipulated according to an established ratio (as illustrated in FIG. 2). The single loop consistency control scheme of the prior art has many limitations; one of them is its effect on specific energy. Indeed small changes in in-feed dilution or in flat zone dilution required for consistency control have significant impact on refiner motor load and much more so than changes in conical zone dilution. Another limitation of the single loop consistency control scheme is that the same discharge consistency can be obtained with different distributions of dilution water flows among in-feed, flat zone and conical zone dilutions. On the other hand, refining intensity and pulp quality will be different at these different distributions, a source of problems if not properly recognized. This explains why a refining condition that is evaluated only in terms of specific energy and blow line consistency can produce very different pulp properties.

This problem is partly addressed in U.S. Pat. No. 6,778,936 B2 where consistency profile is estimated using temperature sensors and a refining zone consistency is controlled either by manipulation of a dilution flow or by changing the refiner feed rate. However, in this previous U.S. patent no distinction has been made in the use of dilution water added before or during refining for consistency control. Only one consistency is being controlled. The objective there was to stabilize refining consistency not to adjust the target consistency for quality control. For example, there is no mention of the need to adjust refining consistency as a function of production rate to overcome loss of certain pulp properties. The same issue of quality loss due to production rate change is another limitation of the single loop control scheme.

A very common problem in TMP installations is the loss of pulp quality at high production rate, Murton K. D. et al., "Production rate effect on TMP pulp quality and energy consumption. J. Pulp Paper Sci., 23(8): J411–J416, 1990". It has been suggested that this loss of pulp strength at high production rate could be attributed to an increase in refining intensity associated with a decrease in pulp residence time. Indeed at high production rate the motor load has to increase to apply a sufficient amount of energy per tonne. At higher motor load, more steam is generated. The higher rate of steam generation results in a higher steam velocity at the same specific energy, and therefore a lower pulp residence time and a higher refining intensity. This problem can be partly offset by proper adjustment of refining consistency but there is no indication in the literature on how to achieve this compensation and how to adjust refining consistencies as a function of production rate.

Although control of discharge consistency is common practice, current methods of control do not recognize the possibility to control independently refiner inlet consistency, which is solely dependant of the in-feed and flat zone dilution, production and consistency of the incoming stock; and the discharge consistency, and this creates severe limitations in the ability to change refining intensity.

SUMMARY OF THE INVENTION

References herein to conical disk refiners are to be understood as references to high consistency conical disk refiners as used in TMP (thermo-mechanical pulp) or CTMP (chemothermo-mechanical pulp) plants as primary, secondary, tertiary or reject refiners and operating at blow line consistencies greater than 30% .

It is an object of this invention to provide an improved method of refining wood chips or pulp in a high consistency conical disc refiner.

It is a particular object of this invention to control the consistency of wood pulp at the discharge outlet of a conical disc refiner to a target consistency.

It is a further object of this invention to establish a pulp consistency for acceptable refining intensity in the refiner.

It is a more specific object of the invention to maintain a target pulp consistency at discharge by a controlled addition of dilution water to the conical refining zone of a conical disc refiner.

It is a further more specific object of the invention to establish a desired refining intensity in a conical disc refiner by controlled addition of dilution water to the refiner, upstream of the conical refining zone.

In accordance with one aspect of the invention, there is provided a method of refining wood pulp comprising: i) providing a conical pulp refiner comprising a refiner housing having a pulp inlet and a pulp outlet with a refining zone therebetween, said refining zone comprising a flat upstream refining zone and a conical downstream refining zone, ii) feeding pulp through said pulp refiner from said pulp inlet to said pulp outlet and refining the pulp in said refining zone, and iii) adding a controlled amount of dilution water to said pulp upstream of said conical refining zone to establish a pulp consistency in said refining zone effective to maintain an acceptable refining intensity for refined pulp quality.

In accordance with another aspect of the invention, there is provided a method of refining wood pulp comprising: i) providing a conical pulp refiner comprising a refiner housing having a pulp inlet and a pulp outlet with a refining zone therebetween, said refining zone comprising a flat upstream refining zone and a conical downstream refining zone, ii) feeding pulp through said pulp refiner from said pulp inlet to said pulp outlet at a selected production rate, and refining the pulp in said refining zone with discharge of refined pulp of a target consistency at said pulp outlet, and iii) adding a controlled amount of dilution water to said conical refining zone to maintain said target pulp consistency at said pulp outlet.

In accordance with still another aspect of the invention, there is provided a method of refining wood pulp comprising: a) providing a conical pulp refiner comprising a refiner housing having a pulp inlet and a pulp outlet with a refining zone therebetween, said refining zone comprising a flat, upstream refining zone and a conical, downstream refining zone, b) feeding pulp through said pulp refiner from said pulp inlet to said pulp outlet at a selected production rate, and refining the pulp in said refining zone with discharge of refined pulp of a target consistency at said pulp outlet, c) adding a first controlled amount of dilution water to said pulp upstream of said conical refining zone, in response to loss of water in said pulp, to establish a pulp consistency effective to maintain an acceptable refining intensity for refined pulp quality, relative to said production rate in said refining zone, and d) adding a second controlled amount of dilution water to said conical refining zone, to maintain said target pulp consistency at said pulp outlet.

In another aspect of the invention, there is provided a method of operating a conical disk refiner comprising: monitoring a pulp discharge consistency of the refiner, and controlling the discharge consistency to a desired value by adjustment of the flow rate of dilution water fed to a conical zone of the refiner.

In still another aspect of the invention, there is provided a method of operating a conical disk refiner comprising: monitoring pulp consistency at an inlet of a refining zone of the refiner, and controlling the pulp consistency to a desired value by adjustment of at least one of: (i) flow rate of infeed dilution water to the refining zone, and (ii) flow rate of dilution water to a flat zone of the refining zone.

A key element of this invention is adjusting refining intensity through changes in refining consistency profile and thus compensating for the detrimental effect of high production rate on pulp quality.

Pulp consistency is controlled by two control loops in two locations rather than by one single control loop at one location as commonly practiced in the prior art. The two locations are: at the inlet of the refining zone (feed consistency) and at the refiner discharge (blow line consistency). The refiner discharge or blow line consistency is controlled independently of the inlet consistency by manipulation of dilution water flow rate within the refining zone (CD zone in conical disc refiners).

Inlet consistency (or consistency at the beginning of the refining zone) is controlled by adjustment of the feed or flat zone dilution or both.

Target inlet consistency is adjusted to achieve the desired refining intensity. In the prior practice with modern conical disc refiners, the dilution water is added in the conical refining zone thus presenting an additional variable to manipulate for the control of the refiner.

In accordance with the invention, consistency at the inlet of the refiner can be increased while maintaining the discharge consistency (blow line consistency) constant. As a result the average refining consistency becomes higher while the consistency of the pulp at the periphery of the plates remains constant, thus avoiding plugging of the plates. The refiner motor load will also increase but can easily be brought back to its original value through an increase in the plate gaps. The result is an operation at the same motor load and specific energy but higher average refining consistency which means higher pulp residence time, and therefore lower refining intensity. It becomes then possible to adjust refining intensity at constant specific energy and in particular compensate for some of the deterioration of pulp quality associated with an operation at high production rate. Very important also is the fact that the consistency at the periphery of the plate can be maintained in an acceptable range while the average refining consistency is adjusted over a much wider range than was possible previously, and without addition of water in the refining zone.

DESCRIPTION OF PREFERRED EMBODIMENTS WITH REFERENCE TO THE DRAWINGS

Figure 1:
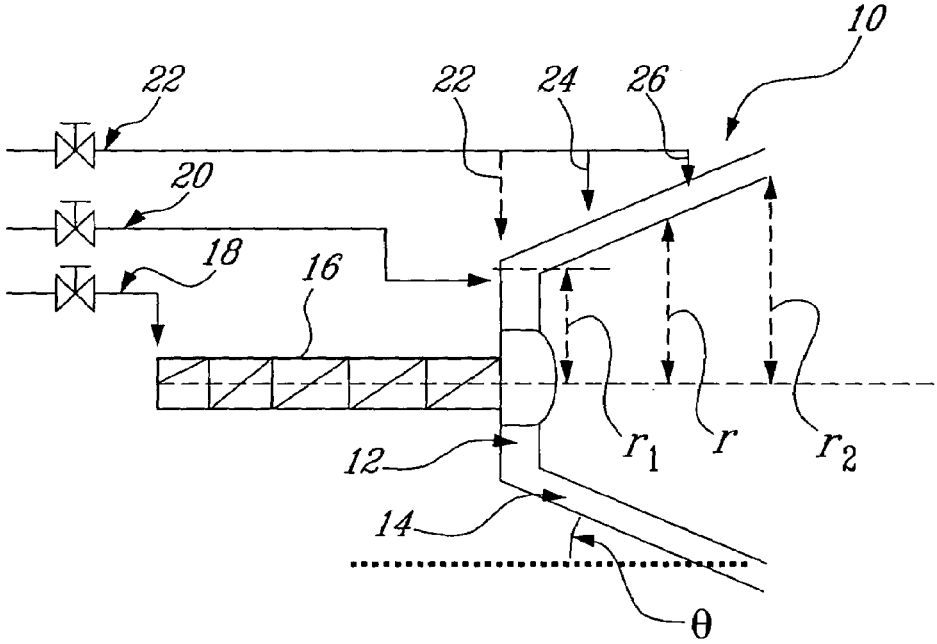
FIG. 1 is a simplified schematic diagram showing input variables and the two refining zones of a conical disc refiner.

With further reference to FIG. 1, a conical refiner 10 is illustrated schematically. Conical refiner 10 has a gap flat zone 12, and a gap conical zone 14.

Conical zone 14 may be considered to comprise a multiplicity of zones of different radii, for example at radii $r_1$, r and $r_2$ in FIG. 1.

Conical zone 14 has an angle of slope θ.

Refiner 10 has an inlet 16 for chips or pulp to be refined, and dilution infeed line 18, dilution flat zone line 20 and dilution conical zone line 22 for feed of dilution water to inlet 16, flat zone 12 and conical zone 14, respectively. Line 22 may have branch line 24, 26 and 28 for feeding dilution water in line 22 to different parts of conical zone 14. Thus, for example, branch line 24 feeds dilution water to an upstream or inlet end of conical zone 14.

Figure 2:
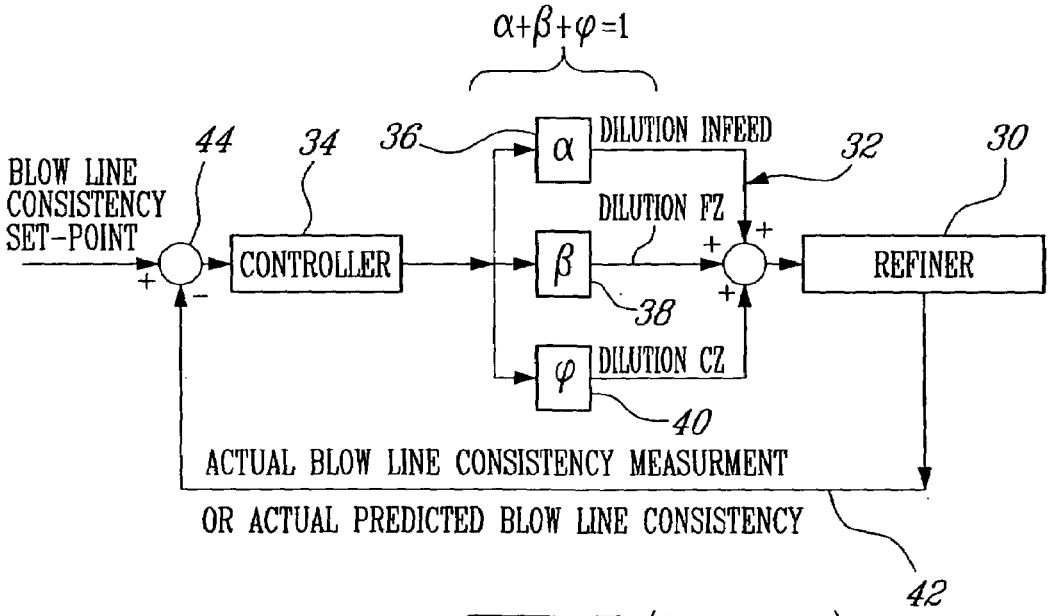
Fig. 2 (Prior Art)
FIG. 2 is a schematic single control loop for adjusting discharge consistency according to the prior art.

With further reference to FIG. 2, there is shown schematically a prior art refining system in which a refiner 30 has a dilution unit 32 and a controller 34.

The dilution unit 32 has a dilution infeed component 36, a dilution flat zone component 38 and a dilution conical zone component 40, all of which are activated together by controller 34 in response to information dispatched in line 42 from the refiner 30, which information is typically an actual measurement of blow line consistency or an actual predicted blow line consistency. The controller 34 comprises the information on blow line consistency in line 42 with an established blow line consistency set point 44 and responds with a change in the dilution water flow rate as required, which change in dilution water is dispatched to all three components 36, 38 and 40, respectively in proportions α, β and Φ of the amount i.e. $\alpha+\beta+\Phi=1$. The proportions α, β, and Φ are typically determined from experience.

In this prior art system, there is no provision for feeding dilution water independently to the different refining and feed zones of the refiner 30.

Figure 3:
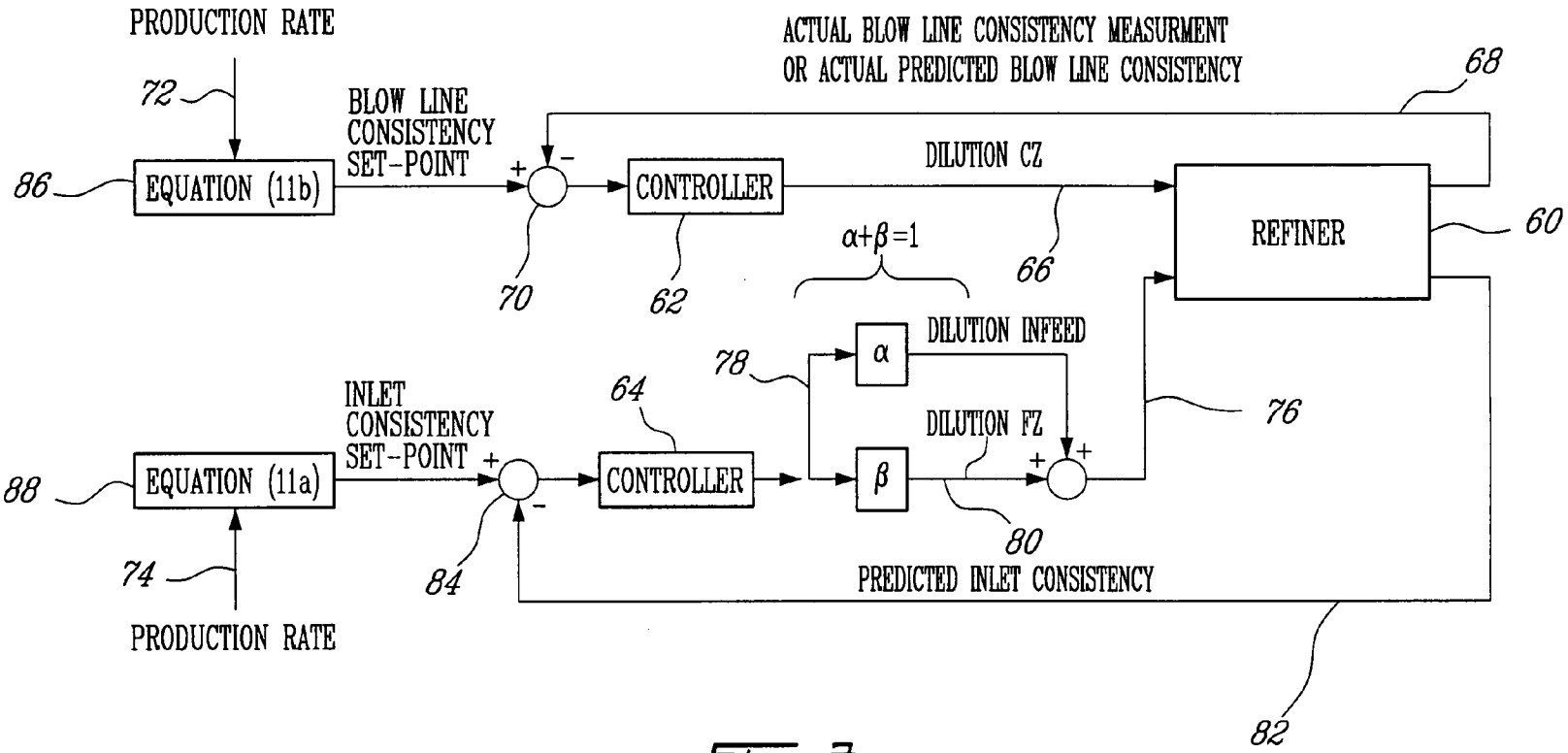
FIG. 3 is a schematic of two control loops to control the discharge consistency and the inlet consistency in accordance with the invention.
Figure 4:
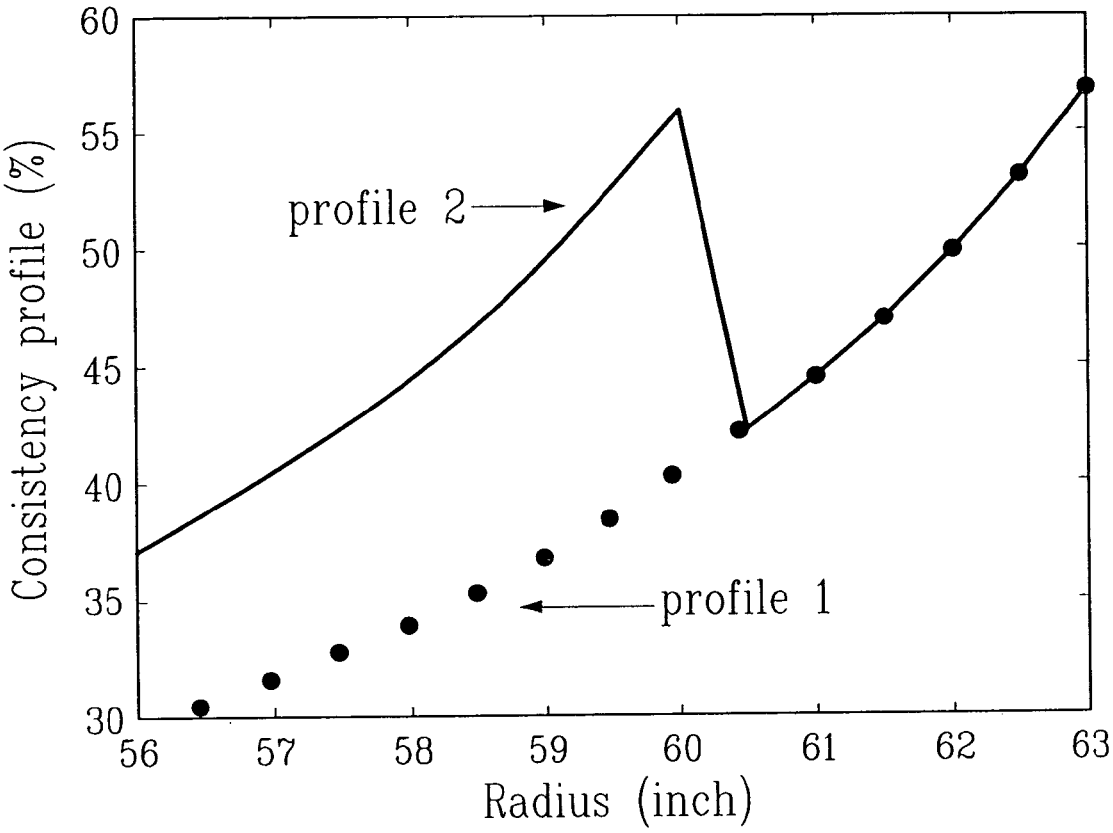
FIG. 4 shows an example of two consistency profiles; profile (1), where all the dilution water is added at the in-feed. This resulted in a low inlet consistency. Profile (2) corresponds to a certain repartition of the total dilution flow between in-feed and conical zone. As can be seen, in profile (2), both the inlet consistency and the average refining consistency are higher while maintaining the same discharge consistency. This provides an increase of the residence time while maintaining constant specific energy and blow line consistency.

FIG. 3 illustrates a refining system of the invention in which a refiner 60 has independent controllers 62 and 64.

Controller 62 has a dilution conical zone line 66 for feed of dilution water to the conical refining zone of the refiner 60 in response to information dispatched into a line 68 from refiner 60 to controller 62.

This information is, for example, a measurement of actual blow line consistency, or an actual predicted blow line consistency of the operating refiner 60.

The controller 62 compares this information with a blow line consistency set point 70, developed from the production rate 72 in accordance with a relationship equation 74 and responds with dispatch of dilution water, as required, to maintain the target blow line consistency (i.e. the blow line consistency set point 70).

Controller 64 has a dilution line 76 having a dilution infeed branch line 78 and a dilution flat zone branch line 80, for feed of dilution water to the infeed and flat zone of refiner 60, in response to information dispatched in line 82 from refiner 60. This information is, for example, the predicted inlet consistency of the operating refiner 60. The controller 64 compares this information with an established inlet consistency set point 84 developed from the production rate 74 with a relationship equation 88 and responds with dispatch of dilution water, as required, to maintain the target inlet consistency (i.e. the inlet consistency set point 84).

The relationship equation 86 is equation (11b) described hereinafter; and the relationship equation 88 is equation (11a) described hereinafter. The total dilution water dispatched by controller 64 is the sum of the in-feed dilution water and flat zone dilution water which are respective proportions α and β of the total dilution i.e. $\alpha=\beta=1$. These proportions can be selected arbitrarily as long as individual dilution flow rates are sufficiently large to avoid plugging of the dilution orifices.

DETAILED DESCRIPTION OF THE INVENTION

This invention provides a method by which the discharge consistency of a conical disk refiner may be monitored using commercially available blow line consistency sensor or any model based method and is controlled to any desired value purely by adjustments of the dilution water flow to the conical zone of the refiner.

The invention also provides a method by which the pulp consistency at the inlet of the refining zone may be predicted and monitored using conventional material balance equations and may be controlled to any desired value by adjustment of the infeed dilution flow rate, the flat zone dilution flow rate, or any combination of both of these flows.

In these methods, the refiner inlet and discharge consistencies may be maintained to desired values by two independent consistency control loops such as is shown in FIG. 3.

The refiner inlet consistency target may be adjusted for the purpose of changing refining intensity, and in particular, the pulp residence time and therefore refining intensity may be adjusted without changing the consistency of the pulp at the refiner discharge.

The inlet consistency target may be adjusted as a function of production rate in accordance with equations 11a) and b) hereinafter.

The refining intensity may be adjusted as a function of production rate; and in particular, the refining intensity may be decreased with increasing production rate in order to compensate for losses in pulp quality associated with an operation at high production.

Conical disc refiners (CD refiners) are becoming widely utilized in North American mechanical pulping processes. These refiners are made of two discs, one rotating and the other stationary. They also have two refining zones: the flat zone (FZ) and the conical zone (CZ). The chips or pulp are fed through the centre of the stator towards the centre plate of the rotor to be partially refined in the flat zone and then are driven by centrifugal forces into the conical zone where most of the refining takes place. The variables that can be adjusted in the refining flat zone are the throughput rate, the flat zone plate gap, the in-feed dilution, and the flat zone dilution. The manipulated variables in the refining conical zone at a given throughput rate, are conical zone gap and conical zone dilution. The flow of dilution water to the conical zone may be added at the beginning of the zone, somewhere in the middle of the zone, toward the end of the conical zone, or fed as a certain combination of all the above, FIG. (1). The variables that can be controlled are the refiner motor load, the specific energy, the refining intensity, the outlet consistency (blow line consistency), and the inlet consistency. With so many manipulated variables and so many interacting control variables, the CD refiner is a very complex system, difficult to operate, and to understand.

The settings of the manipulated variables affects the residence time of the pulp, and therefore affects the quality of the pulp. Among the control variables that have a large impact on the pulp quality are the applied specific energy and the refining intensity. These two variables depend largely on the mentioned input variables but more specifically they depend on the throughput and on the refining consistency.

The effect of the throughput on pulp quality was addressed in many articles, Murton K. D. et al., "Production rate effect on TMP pulp quality and energy consumption. J. Pulp Paper Sci., 23(8): J411–J416, 1990". The throughput-pulp quality relationship is greatly dependant on whether the refiner is a flat disc or CD disc configuration. It can also depend on plate design and most importantly it depends on the throughput operating range. When the throughput operating range is very large and the objective of the pulp quality control is to meet a given freeness, a high increase of the throughput often results in a decrease in specific energy. This may be attributed to an increase in the generated steam which will increase the velocity of the pulp and therefore will result in a decrease of the pulp residence time. Some pulp properties will then be affected by the associated increase in refining intensity. To overcome this situation, an increase in the throughput should be accompanied by a decrease in the refining intensity in order to overcome the degradation of certain pulp properties that were lost. The easiest way to manipulate the refining intensity is by changing the refining consistency. However a much larger impact is obtained when modifying the refiner's rotational speed as described in the US patent U.S. Pat. No. 6,336,602 (by K. Miles) and also in the article "Refining intensity and pulp quality in high consistency refining", by K. Miles, Paperi ja Puu 72(5):508–514, 1990. The approach considered here is restricted to changing the refining intensity through changing the refining consistency as will be explained in the following.

Consistency Profile

Refining consistency was recognized in the article "The flow of pulp in chip Refiners" by K. Miles et al., J. Pulp Paper Sci., 16(2): J63–J72, 1990, as one of the very important variables that have a direct effect on pulp strength. Operating within the correct consistency range which is somewhat narrow is very critical, Strand, B. C. et al., "Effect of production rate on specific energy consumption in high consistency chip refining. Proc. Intl. Mechanical Pulp Conf., Oslo, (1993)". Increasing consistency within acceptable limits yields an operation at wider plate gaps and helps to develop long fibers, maintain high bulk and avoid clashing plates. Operating outside that range tends to lead to less stable refiner operation. Low consistency yields narrow plate gaps and can result in fiber cutting and loss in strength properties. At very high consistency shivy pulp is produced and the so called dry fibre cutting can take place.

Pulp consistency can be adjusted by changing dilution water flow rates. Some recent CD refiners are equipped with in-feed dilution, flat zone dilution and one or more conical zone dilutions. For such refiners, at the same throughput rate and at the same motor load, a discharge consistency target may be obtained with many different combinations of the dilution flows. That can result in a different consistency profile in the refining zones and different pulp strength properties.

The consistency profile, for a flat disc refiner, can be predicted by the following formula developed in the article "Predicting the performance of a chip refiner. A constitutive approach", by K. Miles et al., J. Pulp Paper Sci., 19(6): J268–J274, 1993.

$$C_o = \frac{1}{\frac{1}{C_i} - \frac{(r_0^2 - r_{in}^2)}{(r_{out}^2 - r_{in}^2)}\frac{E_0}{L}}, \tag{1}$$

where L is the latent heat at the refiner inlet approximated to $L \approx 2258 kJ.kg^{-1}$, $r_{in}$ is the inlet radius of the flat zone, $r_{out}$ is outlet radius of the flat zone and $r_o$ is the radius at any point in the flat zone at which consistency is being evaluated. $E_0$ is the specific energy and $C_i$ is the inlet consistency to the refiner defined as:

$$C_i = \frac{prod}{\frac{prod}{C_p} + \text{dilution}}, \tag{2}$$

where $C_p$ is the consistency of the stock before entering the screw feeder to the refiner, prod is the throughput rate, dilution is the water added at the refiner inlet, and equal distribution of energy in the refining zone is assumed. This is the case for flat disc refiners. However, for CD refiners, it is observed that the two refining zones (flat zone and conical zone) do not distribute energy equally to the pulp. Moreover, most of the energy is being applied to the pulp in the conical zone. This is supported by the fact that, in many installations conical zone plates tend to wear more rapidly than the flat zone plates. Therefore, if the energy applied to the fibres in the flat zone is neglected, then the formula of equation (1) can be modified and used to estimate the consistency profile, $C_{cz}$, for the CD refiner. The expression of that profile will depend on the location $r_c$ in the conical zone where the water is being added. Therefore, at the entrance to the conical zone, the consistency, $C_{i1}$, is given by:

$$C_{i1} = \frac{prod}{\frac{prod}{C_p} + dilution_{infeed} + dilution_{FZ}}, \tag{3}$$

where $dilution_{infeed}$ is the in-feed dilution, and $dilution_{FZ}$ is the flat zone dilution. Then, at any given location, r, prior to $r_c$, the consistency $C_{cz}$ is given by:

$$C_{cz} = \frac{1}{\frac{1}{C_{i1}} - \left(\frac{r^2 - r_1^2}{r_2^2 - r_1^2}\right)\left(\frac{E_0}{L}\right)}. \tag{4}$$

where $C_{i1}$ is as defined in equation (3), $r_1$ is the outlet radius of the flat zone, $r_2$ is the outlet radius of the disc at the end of the conical zone, FIG. (1).

For $r=r_c$, the consistency $C_{cz}$ is given by:

$$C_{cz} = \frac{1}{\frac{1}{C_{i2}} - \left(\frac{r_c^2 - r_1^2}{r_2^2 - r_1^2}\right)\left(\frac{E_0}{L}\right)}, \tag{5}$$

where $C_{i2}$ is given by:

$$C_{i2} = \frac{prod}{\frac{prod}{C_p} + dilution_{infeed} + dilution_{Fz} + dilution_{CZ}}, \tag{6}$$

where $dilution_{CZ}$ is the conical zone dilution and $C_{i2}$ is the consistency at the point where dilution occurs in the conical refining zone.

And then, for any given r after $r_c$, the consistency $C_{cz}$ is given by:

$$C_{cz} = \frac{1}{\frac{1}{C_{i2}} - \left(\frac{r^2 - r_1^2}{r_2^2 - r_1^2}\right)\left(\frac{E_0}{L}\right)}. \tag{7}$$

The discharge consistency or the blow line consistency, $C_{BL}$, is obtained when $r=r_2$, given by:

$$C_{BL} = \frac{1}{\frac{1}{C_{i2}} - 0.0016E_0}. \tag{8}$$

This last equation shows that the same blow line consistency, $C_{BL}$, is obtained by more than one possible way of combining in-feed dilution, flat zone dilution, and conical zone dilution. Each one of these combinations would result in a different consistency profile along the refining zones and therefore, different average refining consistency. To illustrate that, FIG. (4) shows an example of two consistency profiles; profile (1), where all the dilution water is added at the in-feed. This resulted in a low inlet consistency. Profile (2) corresponds to a certain repartition of the total dilution flow between in-feed, flat zone and conical zone. As can be seen, in profile (2), both the inlet consistency and the average refining consistency are higher while maintaining the same discharge consistency. This provides an increase of the residence time while maintaining constant specific energy and blow line consistency.

For a given consistency profile the changes and the fluctuations of the $C_{i2}$, inlet consistency, affect the variations of the blow line consistency, $C_{BL}$. In fact, taking the derivative of $C_{BL}$, equation (8), with respect to $C_{i2}$ leads to:

$$\frac{\partial C_{BL}}{\partial C_{i2}} = \left(\frac{C_{BL}}{C_{i2}}\right)^2. \tag{9}$$

This implies that $$\partial C_{BL} = \left(\frac{C_{BL}}{C_{i2}}\right)^2 \partial C_{i2}. \tag{10}$$

Knowing that $C_{BL}>C_{i2}$, this equation shows that variations of $C_{i2}$ are largely amplified and that they contribute tremendously to the variations of the discharge consistency. The higher the discharge consistency, the more important are these variations. This illustrates the need to control and stabilize inlet consistency variations. An independent control of discharge consistency using the dilution flow in the refining zone will also alleviate this problem. With such discharge consistency control, changes in inlet consistency are feasible. This feature can be exploited at high production rate as described in the following section.

High Throughput Rate

As mentioned before, when refining at high production rate, more steam is generated which reduces the pulp residence time, consequently affecting certain pulp strength properties. One way to overcome this problem is by reducing the refining intensity at high production rate. As explained in the article "Refining intensity and pulp quality in high consistency refining", by K. Miles, Paperi ja Puu 72(5):508–514, 1990, this can be done using one of the two following ways. The most effective but also the most difficult one is by adjustments of the refiner rotational speed. The second method which is more practical for an existing operation, is by increasing refining consistency. For CD refiners, that can be accomplished by increasing $C_{i1}$ while keeping the discharge consistency to an acceptable level that will be dependent on the production rate. $C_{i1}$ is indicative of the inlet consistency to the refiner. Therefore the in-feed dilution and the flat zone dilution serve to adjust the consistency of the flow to the refiner while the conical zone dilution adjusts $C_{cz}(r=r_c)$, equation (5), which will result in adjustment of the discharge consistency, $C_{BL}$ and prevents the pulp from drying when $C_{i1}$ is too high.

To overcome the degradation of certain pulp properties at high production rate, the inlet consistencies, $C_{i1}$ and the discharge consistency $C_{BL}$ should be adjusted to target values, which are adjusted as a function of production rate, such as:

$$C_{i1}=\alpha_{infeed}\text{prod}+\beta_{infeed} \tag{11a}$$

$$C_{BL}=\alpha_{BL}\text{prod}+\beta_{BL} \tag{11b}$$

Note, that $C_{BL}$ is function of $C_{i1}$ and $C_{cz}(r=r_c)$. Furthermore, $C_{BL}$ can be adjusted by adjusting $C_{cz}(r=r_c)$ without affecting $C_{i1}$. Coefficients $\alpha_{infeed}$, $\beta_{infeed}$, $\alpha_{BL}$, and, $\beta_{BL}$ are selected to ensure consistency targets within the stable operating range, to provide sufficient response of the motor load to changes in plate gap and a positive response of the motor load to increases in the in-feed and/or flat zone dilution flow rate. A situation where an increase in this dilution water flow rate leads to an increase in the motor load is considered abnormal and undesirable. An on-line estimation of process gains is implemented to detect abnormal or undesirable operating conditions. The production rate influences the specific energy to a given freeness and the pulp properties for conical disc refiners, Strand B. C. et al., "Effect of production rate on specific energy consumption in high consistency chip refining. Proc. Intl. Mechanical Pulp Conf., Oslo, 1993". The consistency should be adjusted in order to allow increase of the specific energy that will compensate for this effect and maintain a stable pulp quality at various levels of production rate. The relationships, equation (11a) and (11b), between production rate and target inlet and discharge consistencies are determined experimentally. The coefficients in equation (11a) are determined first. Assuming that the operating production rate can change between a low production rate, denoted by $Prod_{low}$, and a high production rate, denoted by $Prod_{high}$ and, assuming also that the refiner operates around its normal discharge consistency denoted, $C_{BLoperation}$ then, the determination of the coefficients, $\alpha_{infeed}$ and $\beta_{infeed}$, is carried out in two steps. First step consists in adjusting the production rate to $Prod_{low}$, then in gradually increasing and decreasing the in-feed and/or flat zone dilution flow rate, i.e. in decreasing and an increasing the refiner inlet consistency $C_{i1}$, in order to cover the range of stable operating conditions. For each change in the dilution flow rate, $C_{BL}$ is adjusted to $C_{BLoperation}$ by adjusting dilution water in the conical zone. For each of these operating conditions, a pulp sample is taken from the blow line, is strength is measured and associated to $C_{i1}$. From this set of experiments, an optimal $C_{i1}$, denoted $C_{i1optimal_low}$, that corresponds to the strongest pulp measured is chosen. Similar experiments are then carried out at high production, $Prod_{high}$, to determine $C_{i1optimal_high}$. During these two set experiments, at low and high production rate, the flat zone gap and the conical zone gap are maintained constant. The discharge consistency, $C_{BL}$, is also maintained constant at $C_{BL}=C_{BLoperation}$, by adjusting $C_{cz}$. Only inlet consistency through the in-feed and/or flat zone dilution flow rate are varied. The coefficients $\alpha_{infeed}$ and $\beta_{infeed}$ are determined by:

$$\alpha_{infeed} = \frac{C_{i1\text{optimal_high}} - C_{i1\text{optimal_low}}}{Prod_{high} - Prod_{low}} \tag{12a}$$

$$\beta_{infeed} = \frac{C_{i1\text{optimal_low}} Prod_{high} - C_{i1\text{optimal_high}} Prod_{low}}{Prod_{high} - Prod_{low}} \tag{12b}$$

Note that the coefficient $\beta_{infeed}$ is always positive, implying that the inlet consistency has to increase when the production rate increases.

Up to this point, it can be decided to keep the discharge consistency constant, $C_{BL}=C_{BLoperation}$ for the entire production rate which would correspond to $\alpha_{BL}=0$ and $\beta_{BL}=C_{BLoperation}$ in equation (11b). This is a sub-optimal solution that guarantees that for the same discharge consistency, $C_{BL}=C_{BLoperation}$, the inlet consistency would increase when the production rate increases. This would result in a decrease of the refining intensity and therefore an increase of the pulp residence time which is the very desired effect.

In order to determine the optimal values for parameters $\alpha_{BL}$ and $\beta_{BL}$, the production rate and the inlet consistency are first adjusted respectively to $Prod_{low}$ and $C_{i1optimal_low}$. Then the conical zone dilution flow rate is gradually increased and decreased, i.e. the discharge consistency $C_{BL}$ is decreased and increased, in order to cover a wide range of stable operating conditions. For each conical zone dilution change a pulp sample is taken from the blow line and its strength is measured and related to $C_{BL}$. From these set of experiments, $C_{BL}$ optimal, denoted $C_{BLoptimal_low}$, that would result in strongest pulp is chosen. Similar experiments are considered at $Prod_{high}$ and $C_{i1}=C_{i1optimal_high}$ to determine the optimal discharge consistency, $C_{BLoptimal_high}$. Once the optimal discharge consistencies at high and low production rate are known then the coefficient $\alpha_{BL}$ and $\beta_{BL}$ are given by:

$$\alpha_{BL} = \frac{C_{BL\text{optimal_high}} - C_{BL\text{optimal_low}}}{Prod_{high} - Prod_{low}} \tag{13a}$$

$$\beta_{BL} = \frac{C_{BL\text{optimal_low}} Prod_{high} - C_{BL\text{optimal_high}} Prod_{low}}{Prod_{high} - Prod_{low}} \tag{13b}$$

This approach avoids the current situation where the blow line consistency is the main parameter used in consistency control. Since it can be changed with either the in-feed, the flat zone or the conical zone dilution flows, the same blow line consistency can be achieved with very different refining zone consistency. Since the consistency affects the refining intensity and thus the pulp properties, unknown variations in the refining consistency could be avoided. This approach also allows an increase of the inlet consistency, $C_{i1}$, while maintaining the discharge consistency to an acceptable level or constant such that the average refining consistency becomes higher which would imply higher pulp residence time, and therefore lower refining intensity at the same specific energy.

Motor Load Control

When the refining intensity in the main part of the refining zone is maintained at an optimum level by adjusting the inlet consistencies, a stable specific energy can be achieved by controlling the motor load through adjustments of the plate gap. The target motor load is adjusted to obtain the desired specific energy at various production rates, as should normally be done. This is only possible if the consistencies are high enough to ensure a significant response in motor load to a change in plate gap.

The current situation is that both plate gap and consistency are generally used to control motor load. This way, both the refining intensity and the refining energy may be changed at the same time and it is difficult to predict what the consequences will be for the pulp properties in any given situation. The new approach described here gives a better control of the pulp properties based on the current understanding of how the refining intensity and the specific energy affect the pulp properties, Miles K. B. et al. "Wood characteristics and energy consumption in refiner pulps. J. Pulp Paper Sci. 21: J383–J389, 1995". When each factor is controlled separately, it becomes easier to correct pulp quality problems in a systematic way during the daily operation.

The invention claimed is:

1. A method of refining wood pulp comprising:

a) providing a conical pulp refiner comprising a refiner housing having a pulp inlet and a pulp outlet with a refining zone therebetween, said refining zone comprising a flat, upstream refining zone and a conical, downstream refining zone, b) feeding pulp through said pulp refiner from said pulp inlet to said pulp outlet at a selected production rate, and refining the pulp in said refining zone with discharge of refined pulp of a target consistency at said pulp outlet, c) adding a first controlled amount of dilution water to said pulp upstream of said conical refining zone, in response to loss of water in said pulp, to establish a pulp consistency effective to maintain an acceptable refining intensity for refined pulp quality, relative to said production rate in said refining zone, and d) adding a second controlled amount of dilution water to said conical refining zone, to maintain said target pulp consistency at said pulp outlet;

wherein said pulp consistency in step (c) is controlled by said first controlled amount of dilution water, independently of said target pulp consistency in step (d) controlled by said second controlled amount of dilution water.

2. A method according to claim 1 wherein said dilution water in step (c) is added at said inlet and at said flat refining zone.

3. A method according to claim 1 wherein said dilution water in step (d) is added at a plurality of spaced apart points in said conical refining zone.

4. A method according to claim 1 including a step of monitoring pulp consistency in said conical refining zone, with loss of water during refining in said conical refining zone, and adjusting the addition of dilution water in step (d) in response to the monitoring, to maintain said target pulp consistency.

5. A method according to claim 1 wherein said first controlled amount of dilution water controls consistency at the pulp inlet, and said controlled amount is determined from heat and material balance in the refiner.

6. A method according to claim 1 including monitoring pulp consistency at said pulp outlet and determining said second controlled amount of dilution water therefrom.

7. A method according to claim 6 wherein said monitoring comprises sensing said pulp consistency at said pulp outlet with a consistency sensor.

8. A method according to claim 6 wherein said monitoring comprises evaluating process parameters of the refiner and determining the controlled amount of dilution water from the parameters.

9. A method of refining wood pulp comprising:

a) providing a conical pulp refiner comprising a refiner housing having a pulp inlet and a pulp outlet with a refining zone therebetween, said refining zone comprising a flat upstream refining zone and a conical, downstream refining zone, b) feeding pulp through said pulp refiner from said pulp inlet to said pulp outlet at a selected production rate, and refining the pulp in said refining zone with discharge of refined pulp of a target consistency at said pulp outlet, c) adding a first controlled amount of dilution water to said pulp upstream of said conical refining zone, in response to loss of water in said pulp, to establish a pulp consistency effective to maintain an acceptable refining intensity for refined pulp quality, relative to said production rate in said refining zone, and d) adding a second controlled amount of dilution water to said conical refining zone, to maintain said target pulp consistency at said pulp outlet;

wherein said target pulp consistencies at the inlet and the outlet of the refiner are selected as a function of production rate in accordance with equations (11a) and (11b):

$$C_{i1}=\alpha_{infeed}\text{prod}+\beta_{infeed} \quad (11a)$$

$$C_{BL}=\alpha_{BL}\text{prod}+\beta_{BL} \quad (11b).$$

10. A method of operating a conical disk refiner comprising:

monitoring a pulp discharge consistency of the refiner; and controlling the discharge consistency to a desired value by adjustment of the flow rate of dilution water fed to a conical zone of the refiner, wherein said discharge consistency is maintained by a consistency control loop which is independent of a control loop for maintaining pulp consistency at an inlet of a refining zone of the refiner.

11. A method according to claim 10, wherein a refiner inlet consistency target is adjusted in order to change refining intensity in said refiner.

12. A method according to claim 11, wherein the pulp residence time and said refining intensity are adjusted without change in said pulp discharge consistency.

13. A method according to claim 12, wherein said refining intensity is adjusted as a function of production rate.

14. A method according to claim 13, wherein the refining intensity is decreased with increasing production rate to compensate for loss in pulp quality associated with a high production rate.

15. A method of operating a conical disk refiner comprising:

monitoring pulp consistency at an inlet of a refining zone of the refiner; and controlling said pulp consistency to a desired value by adjustment of at least one of:

i) flow rate of infeed dilution water to said refining zone; and ii) flow rate of dilution water to a flat zone of said refining zone, wherein said pulp consistency at said inlet is maintained by a consistency control loop which is independent of a control loop for maintaining discharge pulp consistency of the refiner.

16. A method according to claim 15, wherein said pulp consistency is adjusted by said controlling in order to change refining intensity in said refiner.

17. A method according to claim 16, wherein pulp residence time and said refining intensity are adjusted without change in said pulp discharge consistency.

18. A method of operating a conical disk refiner comprising:

monitoring pulp consistency at an inlet of a refining zone of the refiner; and controlling said pulp consistency to a desired value by adjustment of at least one of:

i) flow rate of infeed dilution water to said refining zone; and ii) flow rate of dilution water to a flat zone of said refining zone, wherein said controlling comprises adjusting said pulp consistency as a function of production rate in accordance with the relationships:

$$C_{i1}=\alpha_{infeed}\text{prod}+\beta_{infeed} \quad (11a)$$

$$C_{BL}=\alpha_{BL}\text{prod}+\beta_{BL} \quad (11b).$$

* * * * *